US009288924B2

(12) United States Patent
Page

(10) Patent No.: US 9,288,924 B2
(45) Date of Patent: Mar. 15, 2016

(54) DESKTOP RECEPTACLE WITH MOUNTING PLATE

(71) Applicant: Group Dekko, Inc., Garrett, IN (US)

(72) Inventor: Richard J. Page, Lake Villa, IL (US)

(73) Assignee: Group Dekko, Inc., Garrett, IN (US)

( * ) Notice: Subject to any disclaimer, the term of this patent is extended or adjusted under 35 U.S.C. 154(b) by 50 days.

(21) Appl. No.: 14/446,730

(22) Filed: Jul. 30, 2014

(65) Prior Publication Data

US 2016/0037666 A1 Feb. 4, 2016

(51) Int. Cl.

| | |
|---|---|
| ***H05K 5/03*** | (2006.01) |
| ***H05K 5/02*** | (2006.01) |
| ***A47B 96/00*** | (2006.01) |

(52) U.S. Cl.

CPC ..... *H05K 5/0247* (2013.01); *A47B 96/00* (2013.01); *H05K 5/03* (2013.01)

(58) Field of Classification Search

USPC ..... 174/50

See application file for complete search history.

(56) References Cited

U.S. PATENT DOCUMENTS

| | | | | |
|---|---|---|---|---|
| 7,265,292 | B2 * | 9/2007 | Greenfield | H02G 3/14 174/50 |
| 7,947,903 | B2 * | 5/2011 | Peck | H02G 3/14 174/50 |
| 8,053,671 | B1 * | 11/2011 | Shotey | H02G 3/14 174/481 |

* cited by examiner

*Primary Examiner* — Dhirubhai R Patel

(74) *Attorney, Agent, or Firm* — Taylor IP, P.C.

(57) ABSTRACT

A desktop receptacle assembly includes a box having a bottom surface, an electrical connection assembly held within the box, a first finger connected to the bottom surface that has a first portion connected to the bottom surface and a second portion connected to the first portion, the first portion having a first width and the second portion having a second width that is greater than the first width, and a mounting plate associated with the bottom surface that includes at least one bracket and a first finger opening associated with the first finger. The first finger opening has a first opening width corresponding to the first width of the first finger and a second opening width corresponding to the second width of the first finger.

16 Claims, 3 Drawing Sheets

DESKTOP RECEPTACLE WITH MOUNTING PLATE

BACKGROUND OF THE INVENTION

1. Field of the Invention

The present invention relates to desktop receptacles, and, more particularly, to desktop receptacles that are mounted with plates.

2. Description of the Related Art

Desktop receptacles are commonly employed in or on desk surfaces to provide data and power connections to electrical devices that are used on the desk surface. Many varieties of desktop receptacle can be employed including built-in receptacles and removable receptacles. Removable desktop receptacles are desirable because they can be taken out of the work surface and replaced with different receptacles that offer different features. Since removable desktop receptacles are not built-in as part of the work surface, they can require additional support to keep the desktop receptacle attached to the work surface. The additional support gives the desktop receptacle stability and keeps the receptacle from easily detaching from the work surface, but can be difficult to attach to the desktop receptacle.

What is needed in the art is a desktop receptacle assembly that can be easily attached to a work surface.

SUMMARY OF THE INVENTION

The present invention provides a desktop receptacle assembly with a bottom surface having one or more fingers attached that can slide in and out of corresponding finger openings formed through a mounting plate.

The invention in one form is directed to a desktop receptacle assembly that includes a box having a bottom surface; an electrical connection assembly held within the box; a first finger connected to the bottom surface that has a first portion connected to the bottom surface and a second portion connected to the first portion, the first portion having a first width and the second portion having a second width that is greater than the first width; and a mounting plate associated with the bottom surface and including at least one bracket and a first finger opening associated with the first finger. The first finger opening has a first opening width corresponding to the first width of the first finger and a second opening width corresponding to the second width of the first finger.

The invention in another form is directed to a desktop receptacle assembly that includes a box having a bottom surface; an electrical connection assembly held within the box; a first finger connected to the bottom surface that has a first portion connected to the bottom surface and a second portion connected to the first portion, the first portion having a first width and the second portion having a second width that is greater than the first width; and a mounting plate associated with the bottom surface and including at least one bracket and a first finger opening associated with the first finger. The first finger opening has a first opening width corresponding to the first width of the first finger.

An advantage of the present invention is that the finger(s) on the bottom of the box can slide in and out of the finger opening(s) on the mounting plate, providing an easy way to attach or detach the box from the mounting plate.

Another advantage is that the mounting plate can be kept attached to the work surface after removing the box and used to support a different box with a finger on the bottom.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
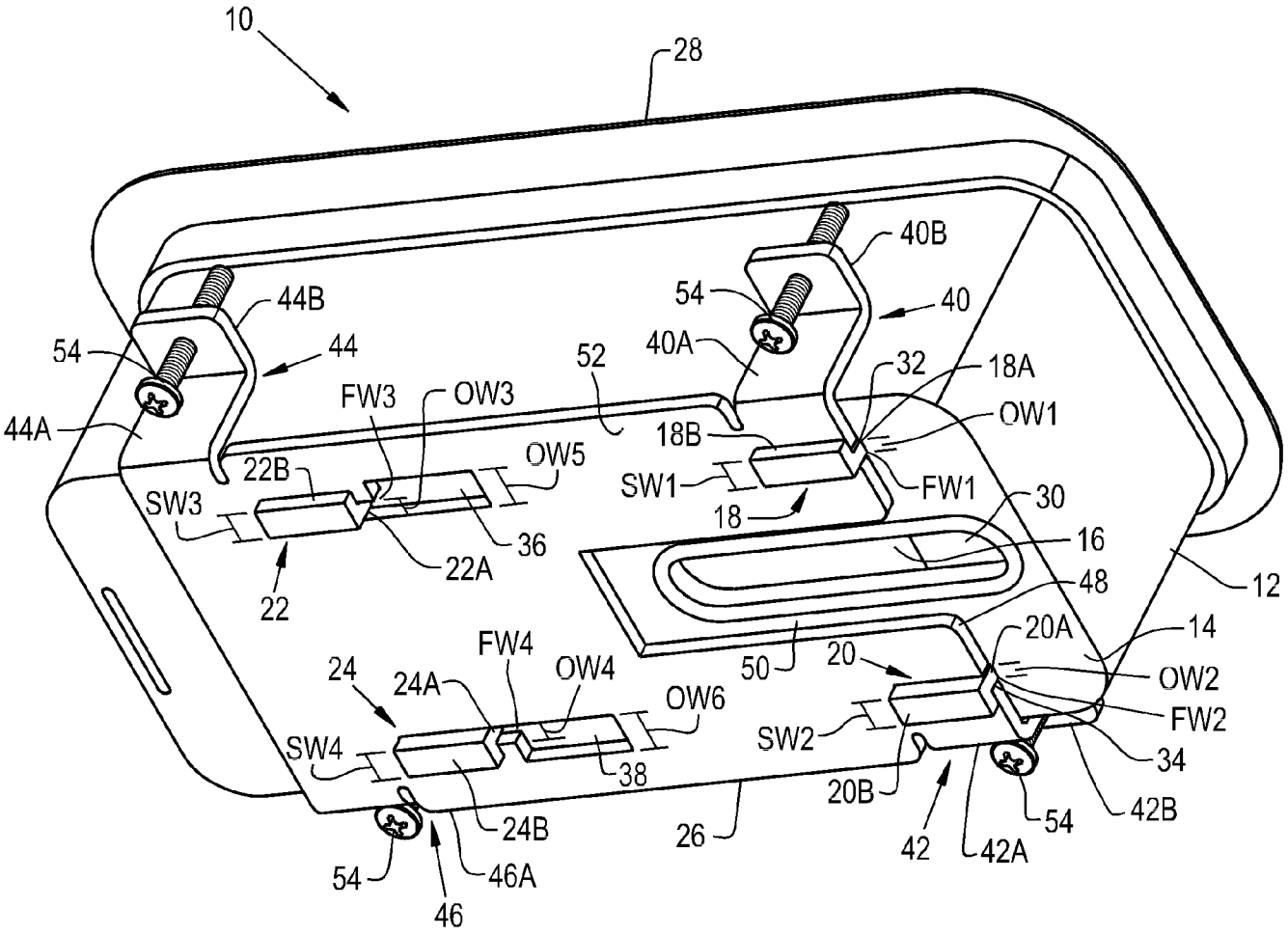
FIG. 1 is a perspective view of an embodiment of the invention.

The exemplifications set out herein illustrate embodiments of the invention and such exemplifications are not to be construed as limiting the scope of the invention in any manner.

DETAILED DESCRIPTION OF THE INVENTION

Referring now to the sole Figure, there is shown a desktop receptacle assembly 10 which generally includes a box 12 with a bottom surface 14, an electrical connection assembly 16 held within the box 12, fingers 18, 20, 22 and 24 connected to the bottom surface 14 of the box 12, and a mounting plate 26 associated with the bottom surface 14 of the box 12. As can be seen, the box 12 has a generally rectangular shape and can include a cover 28 opposite the bottom surface 14. The cover 28 can sit flush with a desk surface (not shown) to hide the electrical connection assembly 16 within the box 12 from sight. The box 12 can also have a cutout 30 formed in its bottom surface 14 that allows the electrical connection assembly 16 to be accessible to electrical connections from the bottom. The electrical connection assembly 16 can be any assembly that allows for electrical power or data connections to be formed between a power or data source and a power or data receiver. A wide variety of such electrical connection assemblies can be used in the present invention. It is contemplated that the box 12 could have many different shapes and sizes, depending on the desktop receptacle assembly 10's application, and the shown box 12 is for illustrative purposes only and should not be taken as limiting the scope of the invention in any manner. Similarly, the box 12 can be made from a large variety of materials, with polymers being a useful material due to their low weight and ease of manufacturing.

Fingers 18, 20, 22 and 24 are connected to the bottom surface 14 of the box 12. Each finger 18, 20, 22 and 24 can be arranged on the bottom surface 14 as desired. While four fingers 18, 20, 22 and 24 are shown in FIG. 1, it is contemplated that only one finger or multiple fingers could be connected to the bottom surface 14. Each finger 18, 20, 22 and 24 has a respective first portion 18A, 20A, 22A and 24A that connects to the bottom surface 14 and a respective second portion 18B, 20B, 22B and 24B that connects to its respective first portion 18A, 20A, 22A and 24A. The fingers 18, 20, 22 and 24 can have an L-shape, with the first portions 18A, 20A, 22A and 24A forming right angles with their respective second portions 18B, 20B, 22B and 24B. While L-shaped fingers 18, 20, 22 and 24 are shown, other shapes are also contemplated for the fingers 18, 20, 22 and 24. Each first portion 18A, 20A, 22A and 24A has a respective first width FW1, FW2, FW3 and FW4 and each second portion 18B, 20B, 22B and 24B has a respective second width SW1, SW2, SW3 and SW4 that is greater than its respective first width FW1, FW2, FW3 and FW4. This allows for the second portions 18B, 20B, 22B and 24B to form ledges that the mounting plate 26 can rest on when it is associated with the bottom surface 14. The first portions 18A, 20A, 22A and 24A should be long enough to accommodate the thickness of the mounting plate 26, so that the mounting plate 26 can rest on the ledges formed by second portions 18B, 20B, 22B and 24B. One optional configuration of the fingers 18, 20, 22 and 24, as shown, is to have finger 20 as a mirror image of finger 18 and finger 24 as a mirror image of finger 22. Such an arrangement can provide additional stability to the mounting plate's 26 association with the fingers 18, 20, 22 and 24 by limiting the amount of transverse movement that the mounting plate 26 can do when it is sliding on to the fingers 18, 20, 22 and 24. Similarly, it is also useful if finger 18 is coaxial with finger 20 on the bottom surface 14 and if finger 22 is coaxial with finger 24 on the bottom surface 14, so that if the mounting plate is properly aligned with fingers 18 and 22 or fingers 20 and 24, it is properly aligned with all fingers 18, 20, 22 and 24. The fingers 18, 20, 22 and 24 can be formed of any material and either formed as an integral part of the box 12 or separately connected to the bottom surface 14.

A mounting plate 26 is associated with the bottom surface 14 of the box 12 and has finger openings 32, 34, 36 and 38 that are associated with respective fingers 18, 20, 22 and 24 and brackets 40, 42, 44 and 46 that will allow the mounting plate 26 to be connected to a desk surface. As can be seen, finger openings 32 and 34 have respective opening widths OW1 and OW2 that only correspond to the first widths FW1 and FW2 of fingers 18 and 20, while finger openings 36 and 38 have respective first opening widths OW3 and OW4 that correspond to the first widths FW3 and FW4 of fingers 22 and 24 as well as respective second opening widths OW5 and OW6 that correspond to the second widths SW3 and SW4 of fingers 22 and 24. As used throughout, "corresponds" refers to the opening width being approximately equal to that of its corresponding width on the finger, so that the finger opening allows for tight sliding of the finger within the finger opening. It should be appreciated that the term "width" is a subset of the broader term "dimension," which can refer to widths, heights, lengths, etc. Mounting plate 26 can have an edge 48 with cutout 50 formed into the edge 48. The cutout 50 can be sized and shaped to surround cutout 30 formed in the bottom surface 14, so that the mounting plate 26 does not obstruct the cutout 30 formed in the bottom surface 14.

The finger openings 32 and 34 can extend to the edge 48, or possibly other edges of the mounting plate 26, so that the mounting plate 26 can slide on to fingers 18 and 20 without the need to line up a second width of the finger openings 32 and 34 with fingers 18 and 20. In contrast, the finger openings 36 and 38 must be aligned with the bottom surface 14 so that the second opening widths OW5 and OW6 overlap the second widths SW3 and SW4 of fingers 22 and 24. Once the second widths SW3 and SW4 overlap their corresponding second opening widths OW5 and OW6, the mounting plate 26 can slide so that the first portions 18A, 20A, 22A and 24A get at least partially held within their corresponding first opening widths OW1, OW2, OW3 and OW4. This allows for the mounting plate 26 to be held by the fingers 18, 20, 22 and 24 and associated with the bottom surface 14, adding support to the box 12. Much like the fingers 22 and 24, it is useful if finger openings 36 and 38 are mirror images of each other to more securely hold the mounting plate 26. Finger opening 32 can also be coaxial to finger opening 34 and/or finger opening 36 can be coaxial to finger opening 38. Other arrangements of the finger openings 32, 34, 36 and 38 are also contemplated, so long as they line up with their respective fingers 18, 20, 22 and 24 and allow for the bottom surface 14 to be slidingly associated with the mounting plate 26. As previously described, the bottom surface 14 can have only one finger or multiple fingers. The mounting plate 26 should have as many corresponding finger openings as the bottom surface has fingers so that the mounting plate 26 can be slidingly associated with bottom surface 14 without the fingers interfering with the mounting plate's 26 association.

The mounting plate 26 includes brackets 40, 42, 44 and 46. As can be seen, the brackets 40, 42, 44 and 46 form supports for the box 12 and associated mounting plate 26 when they are attached to a surface, such as the bottom of a desk surface (not shown). The brackets 40, 42, 44 and 46 are spaced apart so that a bracket is located at each corner of the mounting plate 26, to provide better load distribution between the brackets 40, 42, 44 and 46. Other arrangements of brackets are contemplated, with the number and location of brackets being adjustable as desired. The brackets 40, 42, 44 and 46 can also act to further constrain the box's 12 movement relative to the mounting plate 26, making it easier to properly align the fingers 18, 20, 22 and 24 with the finger openings 32, 34, 36 and 38 and associate the mounting plate 26 with the bottom surface 14. Each bracket 40, 42, 44 and 46 can have a respective base 40A, 42A, 44A and 46A that extends from a main surface 52 of the mounting plate 26 and a respective bearing surface 40B, 42B, and 44B (bracket 46's bearing surface is not shown) that can engage a surface to provide support to the mounting plate 26. Each bracket 40, 42, 44 and 46 can also have an opening formed through its bearing surface that allows fixation screws 54 to bring the bearing surfaces into contact with a support surface. Although the brackets 40, 42, 44 and 46 are shown as L-shaped brackets, other bracket shapes are also contemplated as being used. Further, the brackets 40, 42, 44 and 46 could be formed as an integral part of the mounting plate 26 or could be separate pieces that are attached to the mounting plate 26, if desired. The mounting plate 26 and brackets 40, 42, 44 and 46 can be formed of any material, such as metals due to their strength characteristics, and in any fashion. Similarly, it is contemplated that the mounting plate 26 and brackets 40, 42, 44 and 46 can be adapted to mount to many different surfaces by changing the shape of the mounting plate 26 and/or brackets 40, 42, 44 and 46.

Figure 2:
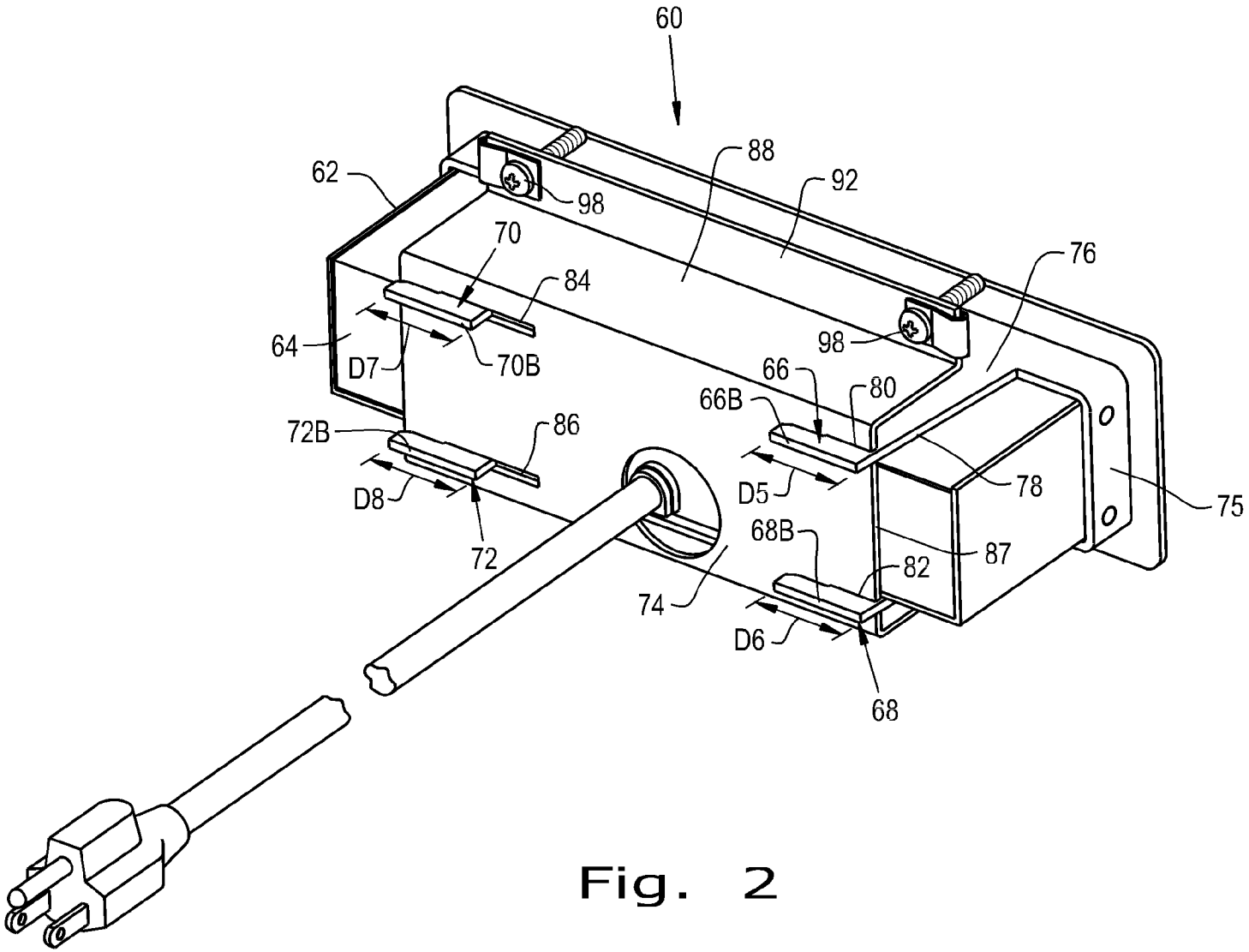
FIG. 2 is a perspective view of another embodiment of the invention.
Figure 3:
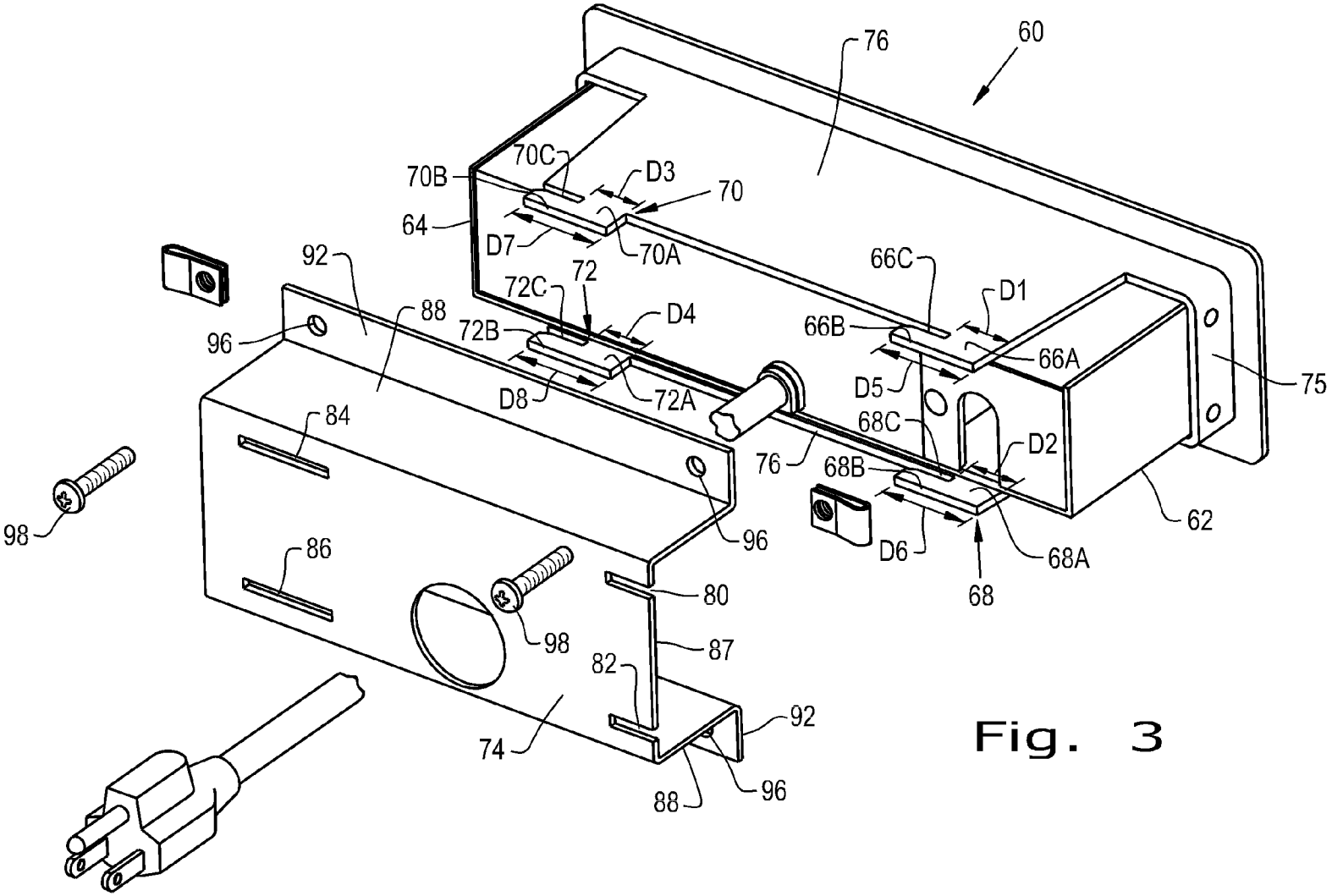
FIG. 3 is a partially exploded view of the desktop receptacle assembly shown in FIG. 2.

Referring now to FIGS. 2 and 3, another embodiment of a desktop receptacle assembly 60 of the present invention is shown. The desktop receptacle assembly 60 includes a box 62 with a bottom surface 64, an electrical connection assembly 16 (shown in FIG. 1) held within the box 62, hooks 66, 68, 70, and 72 associated with the bottom surface 64, and a mounting plate 74 associated with the bottom surface 64. The box 62 has a different shape than previously described box 12, but is otherwise similar.

As can be seen, the hooks 66, 68, 70, 72 are not connected to the bottom surface 64 of box 62, but held to the box 62 by a cosmetic surround 75. As shown, the cosmetic surround 75 is connected to the box 62 by set screws, but could be connected to the box 62 in other ways if desired. The cosmetic surround 75 has side surfaces 76 that extend past the bottom surface 64 of the box 62. The hooks 66, 68, 70, 72 are shown as being formed at an end 78 of the cosmetic surround 75 that extends past the bottom surface 64, but could also be connected to the end 78. Each hook 66, 68, 70, 72 has a respective first portion 66A, 68A, 70A, 72A and second portion 66B, 68B, 70B, 72B. The first portions 66A, 68A, 70A, 72A each have respective first dimensions D1, D2, D3, D4, shown here as a length, and second portions 66B, 68B, 70B, 72B each have respective second dimensions D5, D6, D7, D8, also shown as lengths, that are greater than their respective first dimensions D1, D2, D3, D4. Although the first dimensions D1, D2, D3 and D4 and second dimensions D5, D6, D7 and D8 are shown as lengths, they could also be other types of dimensions such as width and thickness. When the first portions 66A, 68A, 70A and 72A and second portions 66B, 68B, 70B and 72B extend in the same direction, holding edges 66C, 68C, 70C and 72C (shown in FIG. 3) can be formed between the parts of the second portions 66B, 68B, 70B and 72B that are not overlapped by their respective first portions 66A, 68A, 70A and 72A and the side surfaces 76. If the hooks 66, 68, 70 and 72 were connected to the bottom surface 64, the holding edges 66C, 68C, 70C and 72C would be formed between the parts of the second portions 66B, 68B, 70B and 72B that are not overlapped by their respective first portions 66A, 68A, 70A and 72A and the bottom surface 64. These holding edges 66C, 68C, 70C and 72C allow for the mounting plate 74 to be held by the hooks 66, 68, 70 and 72 and associated with the bottom surface 64.

As shown in FIGS. 2 and 3, the mounting plate 74 has openings 80, 82, 84 and 86 that each correspond to a respective hook 66, 68, 70 and 72. The openings 80, 82, 84 and 86, as shown, each have a width that allows its respective hook 66, 68, 70 and 72 to pass through the opening 80, 82, 84 and 86. The openings 80, 82, 84 and 86 each correspond to their respective hook's second portion 66B, 68B, 70B and 72B so that the second portion 66B, 68B, 70B and 72B can pass through the opening 80, 82, 84 and 86 and so the mounting plate 74 can slide along the holding edges 66C, 68C, 70C and 72C of the hooks 66, 68, 70 and 72. As shown, openings 80 and 82 extend to an edge 87 of the mounting plate 74. In this case, it is useful if openings 80 and 82 have a length that is less than that of their corresponding hooks 66 and 68, so that the hooks 66 and 68 will not fall through the openings 80 and 82 and the mounting plate 74 can be held by the hooks 66 and 68. Similarly, it is useful if openings 84 and 86 have lengths that are at least slightly (around 1-2%) larger than their hooks 70 and 72, but less than twice the length's value. This allows the openings 80, 82, 84 and 86 to slide past their respective hooks 66, 68, 70 and 72 while still being able to have the mounting plate 74 slide along the hooks 66, 68, 70 and 72 without falling off. By passing the mounting plate 74 over the second portions 66B, 68B, 70B and 72B and sliding the mounting plate 74 along the holding edges 66C, 68C, 70C and 72C, the mounting plate 74 can be tightly associated with the bottom surface 64 of the box 62 and quickly removed, if desired. To further support the desktop receptacle assembly 60, the mounting plate 74 has one or more brackets 88 that are similar to previously described brackets 40, 42, 44 and 46, but have a flange 92 that extends along a length of the mounting plate 74 and has two mounting openings 96 to hold mounting screws 98. While multiple hooks are shown as being associated with bottom surface 64 and multiple openings on the mounting plate 74, there could be as few as one hook associated with the bottom surface 64, with one respective opening on the mounting plate 74, or more, as desired. It should also be appreciated that the location where the hooks are associated with the bottom surface 64 can be altered, as desired, to change how the mounting plate 74 supports the desktop receptacle assembly 60.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A desktop receptacle assembly, comprising:

a box having a bottom surface and a plurality of sidewalls connected to said bottom surface; an electrical connection assembly held within said box;

a first finger connected to said bottom surface of said box, said first finger having a first portion connected to said bottom surface and a second portion connected to said first portion, said first portion having a first width and said second portion having a second width that is greater than said first width; and a mounting plate connected to said bottom surface of said box and including at least one bracket connected to said mounting plate and a first finger opening at least partially filled by said first finger, said first finger opening having a first opening width corresponding to said first width and a second opening width corresponding to said second width.

2. The desktop receptacle assembly according to claim 1, further including a second finger connected to said bottom surface, said second finger having a third portion connected to said bottom surface and a fourth portion connected to said third portion, said third portion having a third width and said fourth portion having a fourth width that is greater than said third width.

3. The desktop receptacle assembly according to claim 2, wherein said mounting plate includes a second finger opening at least partially filled by said second finger and having a third opening width corresponding to said third width and a fourth opening width corresponding to said fourth width.

4. The desktop receptacle assembly according to claim 3, wherein said first finger and said second finger co-axially connect to said bottom surface and said first finger opening and said second finger opening are co-axially formed through said mounting plate.

5. The desktop receptacle assembly according to claim 4, wherein said first finger is a mirror image of said second finger and said first finger opening is a mirror image of said second finger opening.

6. The desktop receptacle assembly according to claim 5, wherein said second portion is a single extension away from said first portion and said fourth portion is a single extension away from said third portion.

7. The desktop receptacle assembly according to claim 1, wherein said first finger opening is configured to slidingly receive said first finger.

8. The desktop receptacle assembly according to claim 1, wherein said bottom surface includes a cutout and said mounting plate has an opening that surrounds at least a portion of said cutout.

9. The desktop receptacle assembly according to claim 1, wherein said mounting plate includes a plurality of brackets, each of said plurality of brackets including a threaded opening.

10. The desktop receptacle assembly according to claim 9, wherein said plurality of brackets is configured to attach said mounting plate to a desk surface.

11. A desktop receptacle assembly, comprising:

a box having a bottom surface and a plurality of sidewalls connected to said bottom surface, said bottom surface defining a plane; an electrical connection assembly held within said box; a first hook connected to said box and held at least partially below said plane defined by said bottom surface, said first hook having a first portion and a second portion connected to said first portion; and a mounting plate connected to said box and including at least one bracket connected to said mounting plate and a first opening at least partially filled by said first hook, said first opening corresponding to said second portion of said first hook and configured to allow said mounting plate to slide along said first hook.

12. The desktop receptacle assembly according to claim 11, wherein said first portion has a first dimension and said second portion has a second dimension that is greater than said first dimension.

13. The desktop receptacle assembly according to claim 12, wherein said first dimension and said second dimension extend in a same direction.

14. The desktop receptacle assembly according to claim 11, further including a second hook connected to said box and held at least partially below said plane defined by said bottom surface, said second hook having a third portion and a fourth portion connected to said third portion, said third portion having a third dimension and said fourth portion having a fourth dimension that is greater than said third dimension.

15. The desktop receptacle assembly according to claim 14, wherein said mounting plate includes a second opening at least partially filled by said second hook, said second opening corresponding to said fourth portion and configured to allow said mounting plate to slide along said second hook.

16. The desktop receptacle assembly according to claim 11, wherein said mounting plate includes an edge, at least one of said first opening and said second opening extending to said edge.

* * * * *